US011688319B2

(12) United States Patent
Zhao et al.

(10) Patent No.: US 11,688,319 B2
(45) Date of Patent: Jun. 27, 2023

(54) DRIVING METHOD OF A PIXEL CIRCUIT, DISPLAY PANEL, AND DISPLAY DEVICE

(71) Applicant: YUNGU (GU'AN) TECHNOLOGY CO., LTD., Hebei (CN)

(72) Inventors: Dongfang Zhao, Langfang (CN); Yang Shen, Langfang (CN); Zidong Guo, Langfang (CN); Haofeng Zhang, Langfang (CN); Zhe Du, Langfang (CN); Junfeng Li, Langfang (CN); Yong Ge, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/569,309

(22) Filed: Jan. 5, 2022

(65) Prior Publication Data

US 2022/0130311 A1 Apr. 28, 2022

Related U.S. Application Data

(63) Continuation of application No. PCT/CN2020/117990, filed on Sep. 27, 2020.

(30) Foreign Application Priority Data

Dec. 26, 2019 (CN) ..... 201911367990.1

(51) Int. Cl.
*G09G 3/20* (2006.01)

(52) U.S. Cl.
CPC ..... *G09G 3/20* (2013.01); *G09G 2320/0257* (2013.01)

(58) Field of Classification Search
CPC ..... G09G 2320/0257; G09G 3/20
See application file for complete search history.

(56) References Cited

U.S. PATENT DOCUMENTS

2008/0143653 A1* 6/2008 Shishido ..... G09G 3/3233 345/78
2015/0187270 A1 7/2015 Lee et al.
2019/0206320 A1* 7/2019 Nam ..... G09G 3/20

FOREIGN PATENT DOCUMENTS

CN 101256737 A 9/2008
CN 105185305 A 12/2015
(Continued)

OTHER PUBLICATIONS

International Search Report dated Dec. 30, 2020, in corresponding to International Application No. PCT/CN2020/117990; 6 pages (with English Translation).

(Continued)

*Primary Examiner* — Gerald Johnson
(74) *Attorney, Agent, or Firm* — Maier & Maier, PLLC

(57) ABSTRACT

A driving method for driving a pixel circuit. The pixel circuit includes a driving transistor, a data-writing transistor, a compensating transistor, a first initializing transistor, a second initializing transistor and a light-emitting element. The compensating transistor is connected between a gate of the driving transistor and a second pole of the driving transistor. The second pole of the driving transistor is connected to an initialization power supply through the first initializing transistor. The data-writing transistor is connected between a data voltage input terminal and a first pole of the driving transistor. The second initializing transistor is connected between a first signal terminal and a first pole of the driving transistor; and the light-emitting element is connected between the second pole of the driving transistor and a second power voltage input terminal.

13 Claims, 8 Drawing Sheets

(56) References Cited

FOREIGN PATENT DOCUMENTS

| | | | |
|---|---|---|---|
| CN | 105679236 | A | 6/2016 |
| CN | 106297667 | A | 1/2017 |
| CN | 107424555 | A | 12/2017 |
| CN | 107610651 | A | 1/2018 |
| CN | 107610652 | A | 1/2018 |
| CN | 108447445 | A | 8/2018 |
| CN | 109215585 | A | 1/2019 |
| CN | 109285500 | A | 1/2019 |
| CN | 109599062 | A | 4/2019 |
| CN | 110021273 | A | 7/2019 |
| CN | 110047431 | A | 7/2019 |
| CN | 110264946 | A | 9/2019 |
| CN | 110277060 | A | 9/2019 |
| CN | 110942743 | A | 3/2020 |
| KR | 10-2013-0081041 | A | 7/2013 |
| KR | 10-2015-0064544 | A | 6/2015 |

OTHER PUBLICATIONS

Chinese First Office Action dated Dec. 3, 2020 in corresponding Chinese Application 201911367990.1, 18 pages; machine English translation provided.
Supplemental Search dated Dec. 26, 2019 in corresponding Chinese Application 201911367990.1; 1 page.
First Search dated Dec. 26, 2019 in corresponding Chinese Application 201911367990.1, 2 pages.

* cited by examiner

DRIVING METHOD OF A PIXEL CIRCUIT, DISPLAY PANEL, AND DISPLAY DEVICE

CROSS-REFERENCE TO RELATED APPLICATIONS

This is continuation of International Patent Application No. PCT/CN2020/117990, filed on Sep. 27, 2020, which is based on and claims priority to Chinese Patent Application No. 201911367990.1 filed on Dec. 26, 2019, disclosures of which are incorporated herein by reference in their entireties.

TECHNICAL FIELD

Embodiments of the present application relate to the field of display technologies, for example, a driving method for a pixel circuit, a pixel circuit, a display panel and a display device.

BACKGROUND

With the development of the display technologies, the demand of people for the display effect has been getting higher and higher.

A display panel usually includes a plurality of pixel circuits and a plurality of light-emitting elements, and the display panel performs a displaying function by using the pixel circuits to drive the light-emitting elements to emit light.

In the related art, a short-term afterimage exists in a display panel, thus making the display effect poor.

SUMMARY

The present application provides a driving method for a pixel circuit, a display panel and a display device to alleviate a short-term afterimage and improve a display effect.

In a first aspect, embodiments of the present application provide a driving method of a pixel circuit. The pixel circuit includes at least one driving transistor, at least one data-writing transistor, at least one compensating transistor, at least one first initializing transistor, at least one second initializing transistor and at least one light-emitting element. The compensating transistor is connected between a gate of the driving transistor and a second pole of the driving transistor, and the second pole of the driving transistor is connected to an initialization power supply through the first initializing transistor. The data-writing transistor is connected between a data voltage input terminal and a first pole of the driving transistor. The second initializing transistor is connected between a first signal terminal and the first pole of the driving transistor. The light-emitting element is connected between the second pole of the driving transistor and a second power voltage input terminal. The driving method includes the steps below. In an initialization stage, a turn-on control signal is provided for a gate of the first initializing transistor, a turn-on control signal is provided for a gate of the compensating transistor, a turn-on control signal is provided for a gate of the second initializing transistor and a fixed voltage is provided for the first signal terminal. In a data-writing stage, a turn-on control signal is provided for a gate of the data-writing transistor.

In a second aspect, embodiments of the present application further provide a display panel that includes a pixel circuit. The pixel circuit includes at least one driving transistor, at least one data-writing transistor, at least one compensating transistor, at least one first initializing transistor and at least one second initializing transistor. The compensating transistor is connected between a gate of the driving transistor and a second pole of the driving transistor, and the second pole of the driving transistor is connected to an initialization power supply through the first initializing transistor. The data-writing transistor is connected between a data voltage input terminal and a first pole of the driving transistor. The second initializing transistor is connected between a first signal terminal and the first pole of the driving transistor. The pixel circuit further includes a first scanning line, a second scanning line, a third scanning line, a fourth scanning line, a data line, a gate driver and a data driver. The first scanning line is electrically connected to a gate of the first initializing transistor of the pixel circuit, the second scanning line is electrically connected to a gate of the compensating transistor, the third scanning line is electrically connected to a gate of the second initializing transistor, the fourth scanning line is electrically connected to a gate of the data-writing transistor, and the data line is electrically connected to the data voltage input terminal. The first scanning line, the second scanning line, the third scanning line and the fourth scanning line are electrically connected to output terminals of the gate driver in a one to one correspondence, and the data line is electrically connected to an output terminal of the data driver. The gate driver is configured to provide first pulse signals for the first scanning line, the second scanning line and the third scanning line in the initialization stage and is configured to provide the first pulse signal for the fourth scanning line in the data-writing stage. The data driver provides a data voltage for the data line in the data-writing stage.

In a third aspect, embodiments of the present application further provide a display device that includes the display panel provided in the second aspect.

Embodiments of the present application provide a driving method for a pixel circuit, a display panel and a display device. In the initialization stage, turn-on control signals are provided for the gate of the first initializing transistor, the gate of the compensating transistor and the gate of the second initializing transistor, and a fixed voltage is provided for the first signal terminal. In the initialization stage, a gate voltage of the driving transistor is an initializing voltage input from the initialization power supply, and a voltage of the first pole of the driving transistor is a fixed voltage input from the first signal terminal; therefore, the driving transistor can be reset completely. Thus, when grayscales are switched in different frames, no matter whether the display grayscale in the previous frame is the same to the display grayscale in this frame, the driving transistor is returned to the same initializing state in the initialization stage of this frame. Further, during a grayscale-switching process, the degree of capture and release of carriers in an active layer, a gate insulating layer and an interface between the active layer and the gate insulating layer which are inside of the driving transistor tend to be consistent with each other. Further, when different grayscales are switched to the same grayscale, the driving transistor may generate the same driving current, and the brightness of the light-emitting elements are almost the same, thus alleviating the afterimage.

DETAILED DESCRIPTION

A display panel has a short-term afterimage. For example, when light-emitting elements of the display panel which originally display different grayscales are switched to display the same grayscale, the brightness of the light-emitting elements are different, thus making the display effect poor. According to an inventor's research, the display panel usually includes a plurality of pixel circuits. Each of the plurality of pixel circuits includes a driving transistor for driving a light-emitting element to emit light, and the driving transistor controls the brightness of the light-emitting element through controlling a driving current passing through the light-emitting element. A value of the driving current generated by the driving transistor is related to a voltage difference between the gate and the source of the driving transistor. In different display grayscales, values of the voltage difference between the gate and the source of the driving transistor are different. Due to the difference of the voltage difference between the gate and the source of the driving transistor, the working states of the driving transistor are different, so that the degrees of capture and release of carriers in an active layer, a gate insulating layer and an interface between the active layer and the gate insulating layer which are inside of the driving transistor are different. As a result, when different grayscales are switched to the same grayscale, the values of driving currents of the driving transistor are different, then brightness difference occurs, thus causing an afterimage. Moreover, when a gate of the driving transistor is initialized, a source of the driving transistor is usually in a floating state, so that a change in a gate potential also causes a change in a source potential, which makes the reset of the driving transistor to be inadequate. As a result, a short-term afterimage still exists.

Embodiments of the present application provide a driving method for a pixel circuit. The pixel circuit includes a driving transistor, a data-writing transistor, a compensating transistor, a first initializing transistor, a second initializing transistor and a light-emitting element. The compensating transistor is connected between a gate of the driving transistor and a second pole of the driving transistor, and the second pole of the driving transistor is connected to an initialization power supply through the first initializing transistor. The data-writing transistor is connected between a data voltage input terminal and a first pole of the driving transistor. The second initializing transistor is connected between a first signal terminal and the first pole of the driving transistor. The light-emitting element is connected between the second pole of the driving transistor and a second power voltage input terminal.

Figure 1:
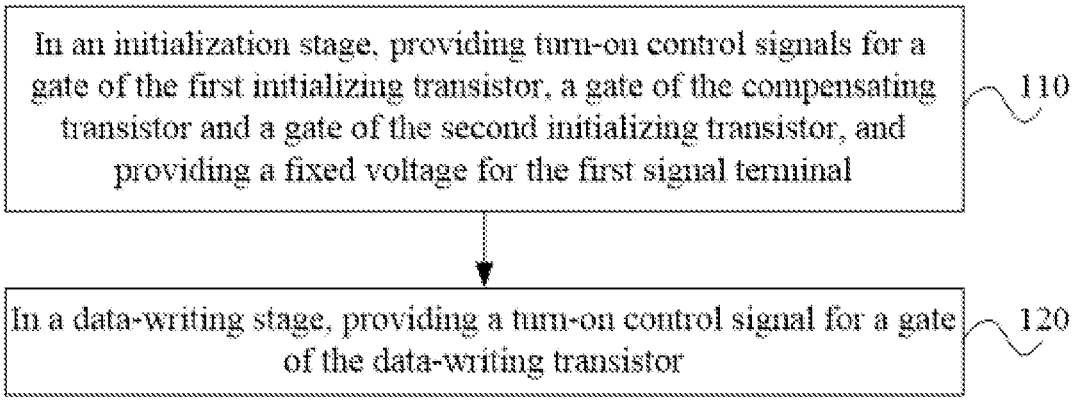
FIG. 1 is a flowchart of a driving method for a pixel circuit according to an embodiment of the present application.

FIG. 1 is flowchart of a driving method for a pixel circuit according to an embodiment of the present application. Referring to FIG. 1, the driving method includes steps 110 to 120 below.

In step 110, in an initialization stage, providing turn-on control signals for a gate of the first initializing transistor, a gate of the compensating transistor and a gate of the second initializing transistor, and providing a fixed voltage for the first signal terminal.

In step 120, in a data-writing stage, providing a turn-on control signal for a gate of the data-writing transistor.

In an embodiment, within one frame, the initialization stage is performed before the data-writing stage.

In an embodiment, in the initialization stage, the turn-on control signals are provided for the gate of the first initializing transistor and the gate of the compensating transistor, so that the first initializing transistor and the compensating transistor can be turned on. An initialization voltage input from the initialization power supply is transmitted to the gate of the driving transistor through the first initializing transistor and compensating transistor which are turned on to make the gate of the driving transistor initialized. Moreover, in the initialization stage, the turn-on control signal is provided for the gate of the second initializing transistor, so that the fixed voltage provided by the first signal terminal is transmitted to the first pole of the driving transistor through the second initializing transistor which is turned on. The first pole of the driving transistor may be a source or a drain of the driving transistor. In an embodiment, in a case that the driving transistor is a P-type transistor, the first pole of the driving transistor is the source of the driving transistor and in a case that the driving transistor is an N-type transistor, the first pole of the driving transistor is the drain of the driving transistor. That is, in the initialization stage, a gate voltage of the driving transistor is an initialization voltage input from the initialization power supply and a voltage of the first pole of the driving transistor is a fixed voltage input from the first signal terminal. That is, in the initialization stage, the voltage difference between the gate of the driving transistor and the first pole of the driving transistor is fixed, which may realize the adequate reset of the driving transistor. Thus, in the display panel including a plurality of pixel circuits, the driving transistor in each of the plurality of pixel circuits may be returned to the same state. When grayscale switching is performed in different frames, no matter whether the display grayscale in the preceding frame is the same to the display grayscale in this frame, in the initialization stage of this frame, the driving transistors are returned to the same initialization state, so that during a grayscale switching process, the degrees of capture and release of carriers in an active layer, a gate insulating layer and an interface between the active layer and the gate insulating layer which are inside the driving transistor tends to be consistent, and when different grayscales are switched to the same grayscale, the driving transistors may generate the same driving current, and the brightness of the light-emitting elements are almost the same, thus alleviating the afterimage.

Embodiments of the present application provide a driving method for a pixel circuit. In the initialization stage, the turn-on control signals are provided for the gate of the first initializing transistor, the gate of the compensating transistor and the gate of the second initializing transistor, and the fixed voltage is provided for the first signal terminal, so that in the initialization stage, the gate voltage of the driving transistor is the initialization voltage input from the initialization power supply and the voltage of the first pole of the driving transistor is the fixed voltage input from the first signal terminal, so as to realize the adequate reset of the driving transistor. When the grayscale switching is performed in different frames, no matter whether the display grayscale in the preceding frame is the same to the display grayscale in this frame, in the initialization stage of this frame, the driving transistors are returned to the same initialization state, so that during a grayscale switching process, the degrees of capture and release of carriers in the active layer, the gate insulating layer and the interface between the active layer and the gate insulating layer which are inside of the driving transistor tend to be consistent, and when different grayscales are switched to the same grayscale, the driving transistors may generate the same driving current, and the brightness of the light-emitting elements are almost the same, thus alleviating the afterimage.

Figure 2:
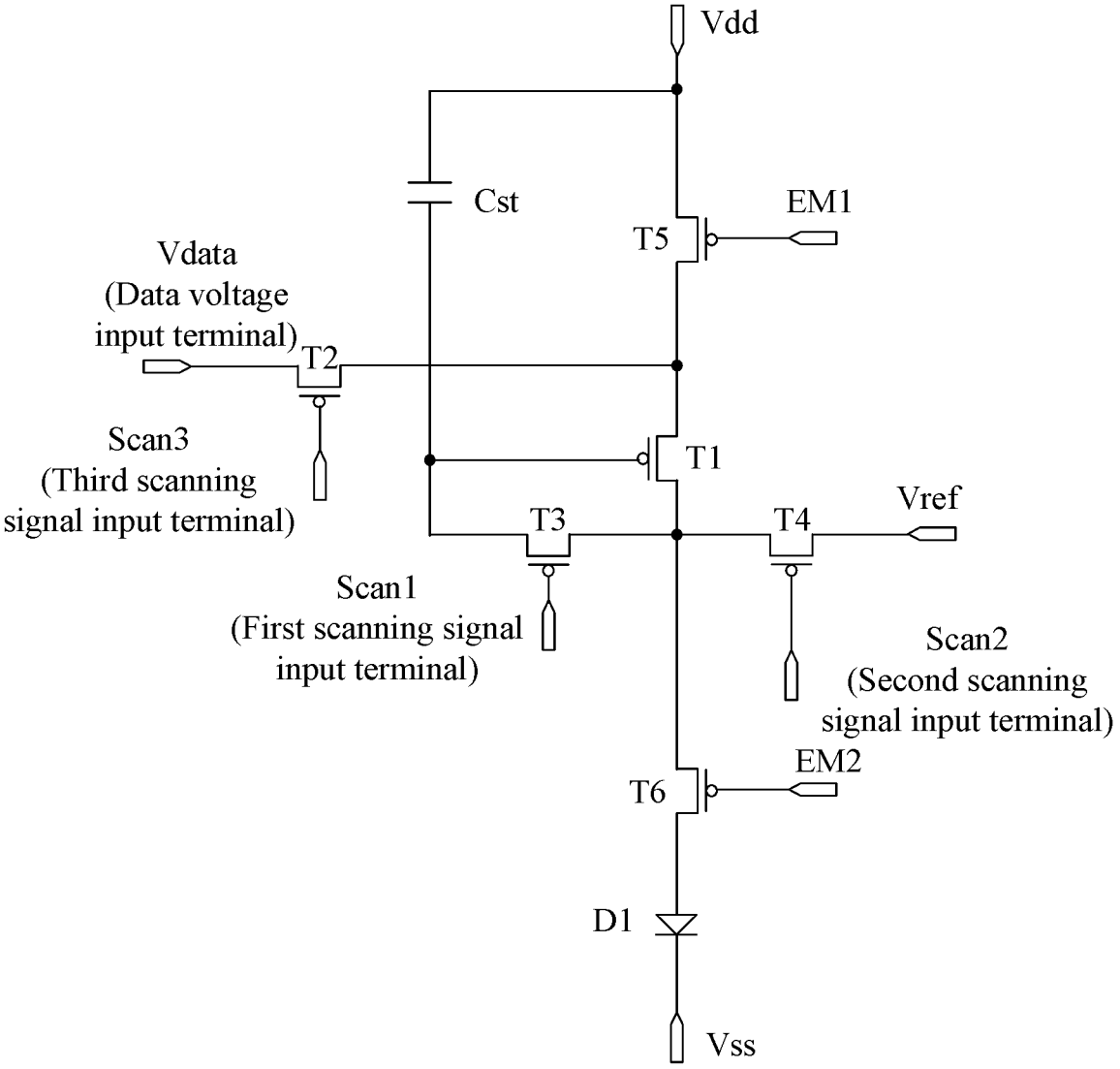
FIG. 2 is a schematic diagram illustrating the structure of a pixel circuit according to an embodiment of the present application.

FIG. 2 is a schematic diagram illustrating the structure of a pixel circuit according to an embodiment of the present application. Referring to FIG. 2, the pixel circuit includes a driving transistor T1, a data-writing transistor T2, a compensating transistor T3, a first initializing transistor T4, a second initializing transistor T5 and a light-emitting element D1. The compensating transistor T3 is connected between a gate of the driving transistor T1 and a second pole of the driving transistor T1, and the second pole of the driving transistor T1 is connected to an initialization power supply Vref through the first initializing transistor T4. The data-writing transistor T2 is connected between a data voltage input terminal Vdata and a first pole of the driving transistor T1. The second initializing transistor T5 is connected between a first signal terminal and the first pole of the driving transistor T1.

The pixel circuit further includes a first light-emitting control transistor T6. The first pole of the driving transistor T1 is electrically connected to a first power voltage input terminal Vdd through the second initializing transistor T5, and the second pole of the driving transistor T1 is electrically connected to a first pole of the light-emitting element D1 through the first light-emitting control transistor T6. A second pole of the light-emitting element D1 is electrically connected to a second power voltage input terminal Vss. The first power voltage input terminal Vdd serves as the first signal terminal.

In an embodiment, the driving transistor T1, the data-writing transistor T2, the compensating transistor T3, the first initializing transistor T4, the second initializing transistor T5 and the first light-emitting control transistor T6 may be P-type transistors or N-type transistors. In a case that those transistors are P-type transistors, a turn-on control signal is a low-level signal; and in a case that those transistors are N-type transistors, the turn-on control signal is a high-level signal. In an embodiment, a gate of the compensating transistor T3 is electrically connected to a first scanning signal input terminal Scan1 of the pixel circuit and a gate of the first initializing transistor T4 is electrically connected to a second scanning signal input terminal Scan2 of the pixel circuit. A gate of the data-writing transistor T2 is electrically connected to a third scanning signal input terminal Scan3 and a gate of the second initializing transistor T5 is electrically connected to a first light-emitting control signal input terminal EM1. A gate of the first light-emitting control transistor T6 is electrically connected to a second light-emitting control signal input terminal EM2. In the following embodiments, those transistors are all P-type transistors, that is, the turn-on control signal is the low-level signal, a signal input from the first power voltage input terminal Vdd is the high-level signal and a signal input from the second power voltage input terminal Vss is the low-level signal.

Figure 3:
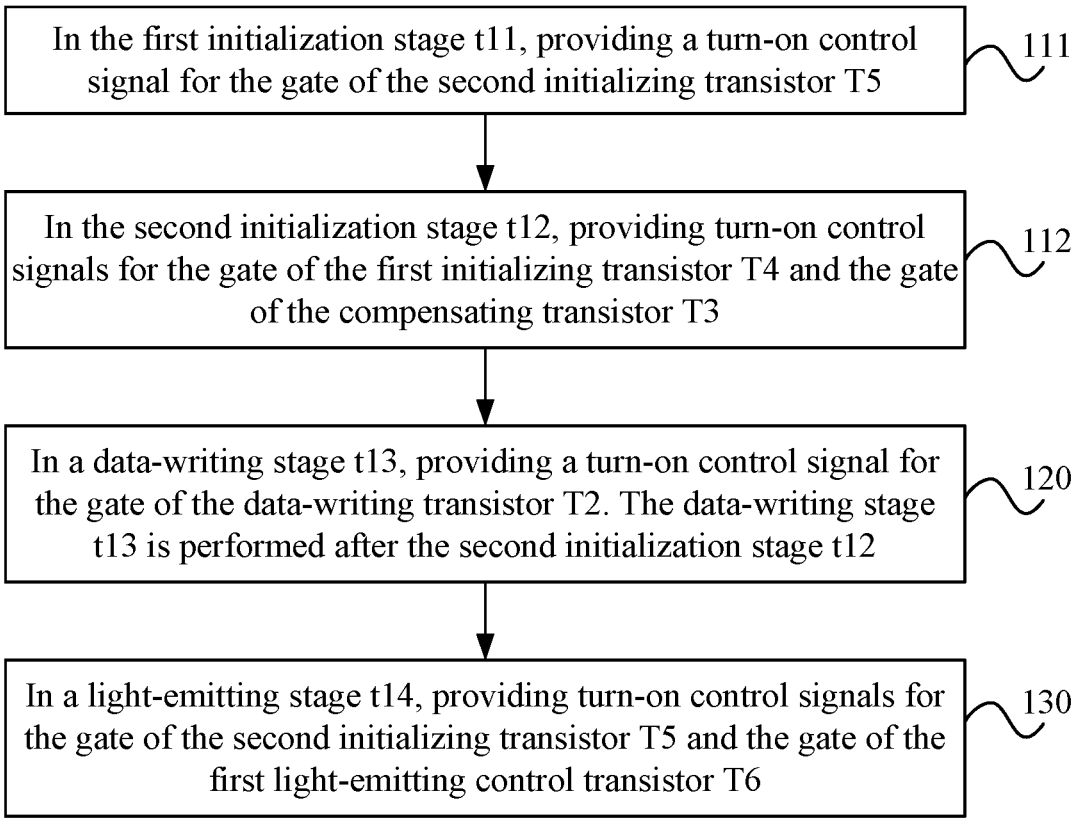
FIG. 3 is a flowchart of another driving method for a pixel circuit according to an embodiment of the present application.
Figure 4:
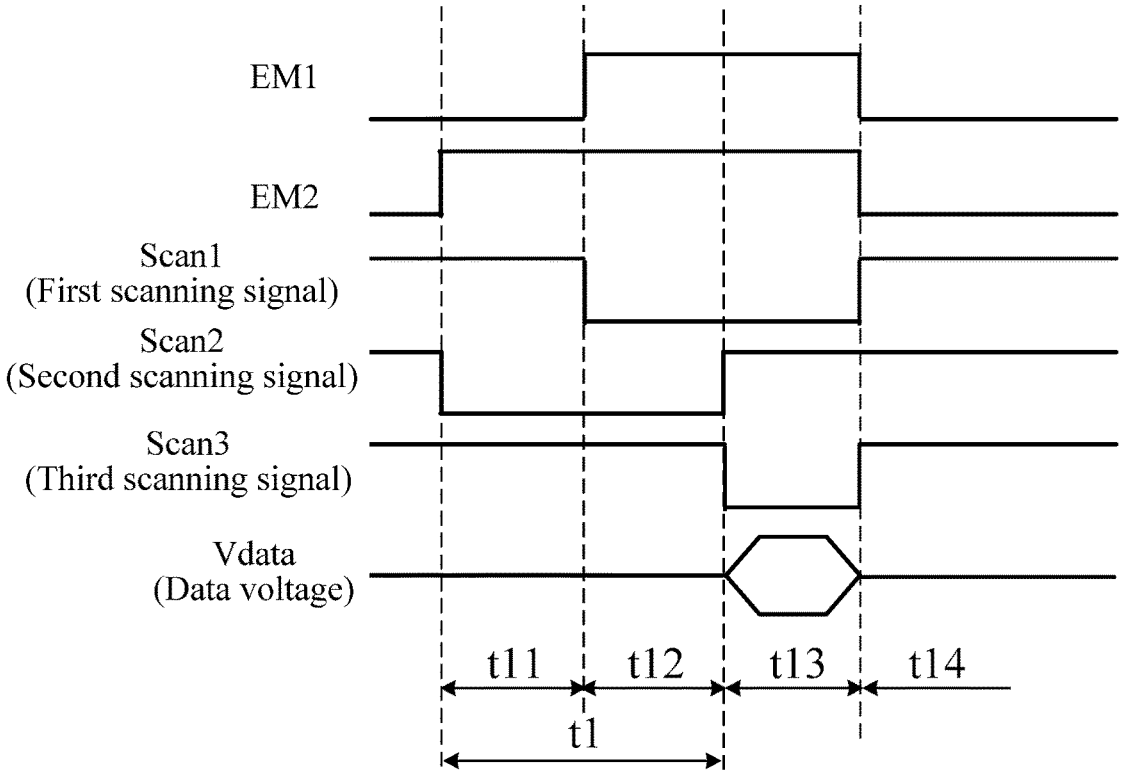
FIG. 4 is a time diagram of the drive of the pixel circuit shown in FIG. 2 according to an embodiment of the present application.

FIG. 3 is a flowchart of another driving method for a pixel circuit according to an embodiment of the present application and FIG. 4 is a time diagram of the drive of a pixel circuit shown in FIG. 2 according to an embodiment of the present application. The time sequence of the drive may be applied to drive the pixel circuit shown in FIG. 2. Referring to FIGS. 2 to 4, the initialization stage t1 in the preceding embodiments includes a first initialization stage t11 and a second initialization stage t12.

The driving method for a pixel circuit includes steps 111 to 130 below.

In step 111, in the first initialization stage t11, providing a turn-on control signal for the gate of the second initializing transistor T5.

In the first initialization stage t11, a low-level signal is provided for the gate of the second initializing transistor T5, that is, the low-level signal is provided for the first light-emitting control signal input terminal EM1, so that the second initializing transistor T5 is turned on. A high-level signal input from the first power voltage input terminal Vdd is transmitted to the first pole of the driving transistor T1 through the second initializing transistor T5 which is turned on, so as to realize the reset of the first pole of the driving transistor T1.

In step 112, in the second initialization stage t12, providing turn-on control signals for the gate of the first initializing transistor T4 and the gate of the compensating transistor T3.

In the second initialization stage t12, a low-level signal is provided for the gate of the first initializing transistor T4, that is, the low-level signal is provided for the second scanning signal input terminal Scan2, so that the first initializing transistor T4 is turned on. A low-level signal is provided for the gate of the compensating transistor T3, that is, the low-level signal is provided for the first scanning signal input terminal Scan1, so that the compensating transistor T3 is turned on. Thus, the initialization voltage provided by the initialization power supply Vref is transmitted to the gate of the driving transistor T1 through the first initializing transistor T4 and compensating transistor T3 which are turned on so as to realize the reset of the gate of the driving transistor T1.

Thus, after the first initialization stage t11 and the second initialization stage t12, the first pole of the driving transistor T1 is initialized, so a voltage of the first pole of the driving transistor T1 is initialized to a voltage input from the first power voltage input terminal Vdd which is a fixed voltage, and a voltage of the gate of the driving transistor T1 is initialized to an initialization voltage input from the initialization power supply Vref. That is, after the first initialization stage t11 and the second initialization stage t12, the voltage difference between the gate and the first pole of the driving transistor T1 is fixed so as to realize the adequate reset of the driving transistor T1, thus alleviating the afterimage. In an embodiment, within one frame, the second initialization stage t12 is performed after the first initialization stage t11.

In step 120, in a data-writing stage t13, providing a turn-on control signal for the gate of the data-writing transistor T2. The data-writing stage t13 is performed after the second initialization stage t12.

In an embodiment, in the data-writing stage t13, a low-level signal is provided for the gate of the data-writing transistor T2, that is, the low-level signal is provided for the third scanning signal input terminal Scan3, so that the data-writing transistor T2 is turned on. A low-level signal is provided for the gate of the compensating transistor T3, that is, the low-level signal is provided for the first scanning signal input terminal Scan1, so that the compensating transistor T3 is turned on. A data voltage input from the data voltage input terminal Vdata is written into the gate of the driving transistor T1 through the data-writing transistor T2, driving transistor T1 and compensating transistor T3 which are turned on. The brightness of the light-emitting element D1 is related to the value of the data voltage of the gate of the driving transistor T1 which is written into.

Referring to FIGS. 1 to 4, the driving method for a pixel circuit further includes steps below.

In step 130, in a light-emitting stage t14, providing turn-on control signals for the gate of the second initializing transistor T5 and the gate of the first light-emitting control transistor T6.

In an embodiment, in the light-emitting stage t14, low-level signals are provided for the gate of the second initializing transistor T5 and the gate of the first light-emitting control transistor T6, so that the second initializing transistor T5 and the first light-emitting control transistor T6 are turned on, and the driving transistor T1 drives the light-emitting element D1 to emit light. That is, in the pixel circuit structure and driving method according to the present embodiment, the second initializing transistor T5 further plays a light-emitting control role, or a light-emitting control transistor is used as the second initializing transistor T5, which is conducive to reduce the number of transistors in the pixel circuit and improve the pixel density.

In the present embodiment, the gate of the driving transistor T1 is reset through the first initializing transistor T4 and the compensating transistor T3. That is, in the pixel circuit structure, the first initializing transistor T4 is electrically connected to the gate of the driving transistor T1 through the compensating transistor T3, so that only one leakage path exists in the pixel circuit, which may reduce the leakage paths, which is conducive to maintain a gate potential of the driving transistor T1 and is further conducive to improve the display effect, compared with a pixel circuit structure in which the gate of the driving transistor T1 is directly initialized through the first initializing transistor T4 (that is the pixel circuit structure in which the first initializing transistor T4 is directly electrically connected to the gate of driving transistor T1).

Figure 5:
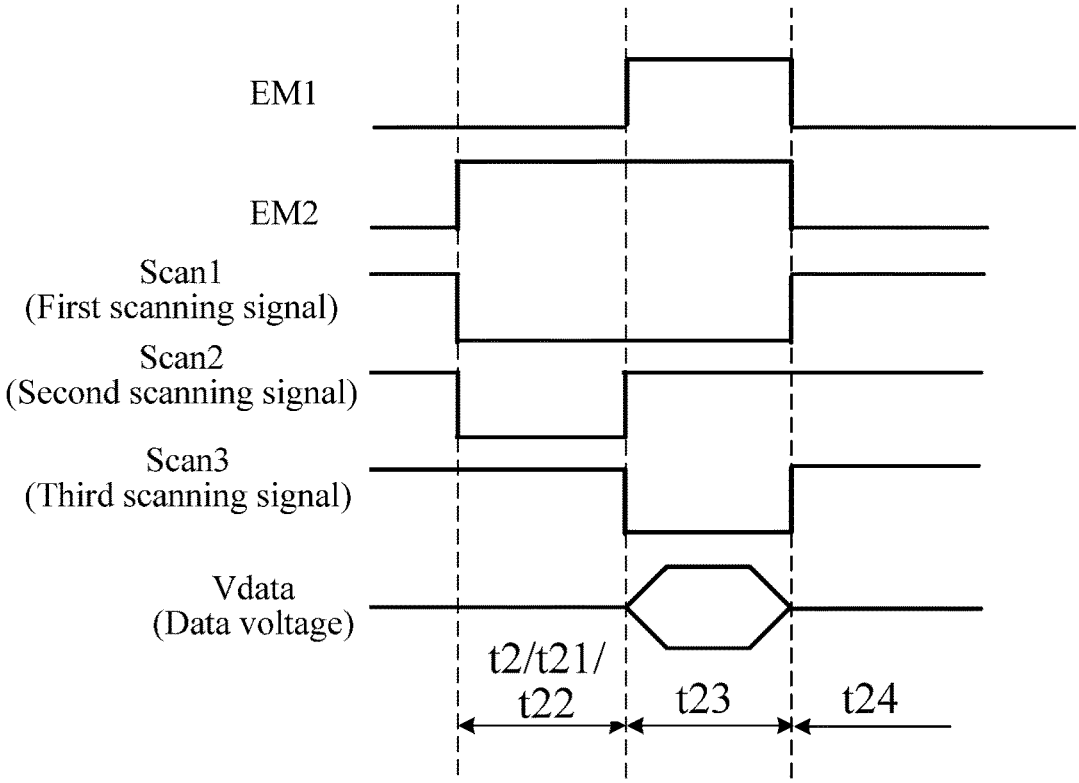
FIG. 5 is another time diagram of the drive of the pixel circuit shown in FIG. 2 according to an embodiment of the present application.

FIG. 5 is another time diagram of the drive of a pixel circuit shown in FIG. 2 according to an embodiment of the present application. The time sequence of the drive may be applied to drive the pixel circuit shown in FIG. 2. Referring to FIG. 5, within one frame, a first initialization stage t21 and a second initialization stage t22 are simultaneously performed.

In an embodiment, the initialization stage t2 includes the first initialization stage t21 and the second initialization stage t22 shown in FIG. 5. The first initialization stage t21 and the second initialization stage t22 are simultaneously performed, which is conducive to shorten the driving period of each pixel circuit (the driving period includes the initialization stage t2, a data-writing stage t23 and a light-emitting stage 24) and is further conducive to drive the display circuit in the display panel with a high pixel density. The working process of the pixel circuit in the data-writing stage t23 and the light-emitting stage t24 of the time sequence of the drive shown in FIG. 5 is consistent with the working process of the pixel circuit in the data-writing stage t13 and the light-emitting stage t14 of the time sequence of the drive shown in FIG. 4, which is not repeated herein.

Referring to FIGS. 4 to 5, the driving method for a pixel circuit further includes steps below.

In the first initialization stage (al shown in FIG. 4 and t21 shown in FIG. 5), a turn-off control signal is provided for the gate of the first light-emitting control transistor T6.

Referring to FIG. 2, FIG. 4 and FIG. 5, a signal provided for the gate of the first light-emitting control transistor T6 is a signal input to the second light-emitting control signal input terminal EM2. In an embodiment, in the first initialization stage, a high-level signal is provided for the gate of the first light-emitting control transistor T6, and then the first light-emitting control transistor T6 is turned off in the first initialization stage.

As for the time sequence of the drive shown in FIG. 4, since the second initializing transistor T5 is turned on in the first initialization stage, a high-level signal input to the first power voltage input terminal Vdd is transmitted to the first pole of the driving transistor T1. A signal input to the gate of the compensating transistor T3 is a high-level signal, so the compensating transistor T3 is turned off. Due to the storage function of a storage capacitor, the gate of the driving transistor T1 maintains the data voltage in the preceding frame. A data voltage of the gate of the driving transistor T1 is a data voltage corresponding to any one of grayscales, and a voltage of the first pole of the driving transistor T1 is a voltage input to the first power voltage input terminal Vdd, so the voltage difference between the gate of the driving transistor T1 and the first pole of the driving transistor T1 is usually less than the threshold voltage, an then the driving transistor T1 is turned on. In the driving method according to the present embodiment, the first light-emitting control transistor T6 is turned off in the first initialization stage through providing a turn-off control signal for the gate of first light-emitting control transistor T6 in the first initialization stage, so as to avoid the display defect brought by light emission of the light-emitting element D1 in the first initialization stage.

As for the time sequence of the drive shown in FIG. 5, since the second initializing transistor T5 is turned on in the first initialization stage, a high-level signal input from the first power voltage input terminal Vdd is transmitted to the first pole of the driving transistor T1. The first initializing transistor T4 and the compensating transistor T3 are turned on, and an initialization voltage input from the initialization power supply Vref is transmitted to the gate of the driving transistor T1. Since the initialization voltage is usually low, the voltage difference between the gate of the driving transistor T1 and the first pole of the driving transistor T1 is less than the threshold voltage, and then the driving transistor T1 is turned on. In the driving method according to the present embodiment, the first light-emitting control transistor T6 is turned off in the first initialization stage through providing a turn-off control signal for the gate of first light-emitting control transistor T6 in the first initialization stage, so as to avoid the display defect brought by light emission of the light-emitting element D1 in the first initialization stage.

Figure 6:
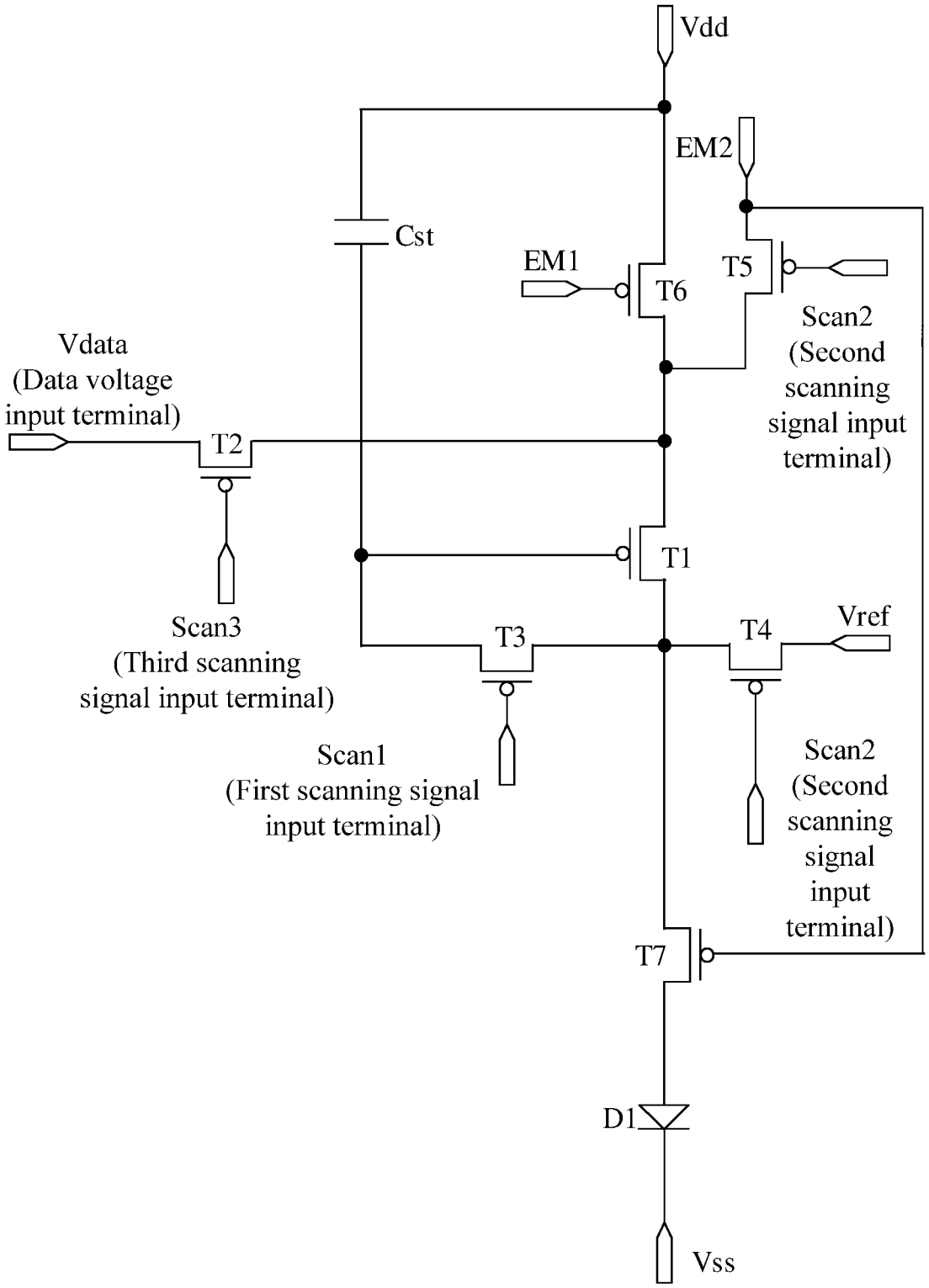
FIG. 6 is a schematic diagram illustrating the structure of another pixel circuit according to an embodiment of the present application.

FIG. 6 is a schematic diagram illustrating the structure of another pixel circuit according to an embodiment of the present application. Referring to FIG. 6, the pixel circuit includes the driving transistor T1, the data writing transistor T2, the compensating transistor T3, the first initializing transistor T4, the second initializing transistor T5 and the light-emitting element D1. The compensating transistor T3 is connected between the gate of the driving transistor T1 and the second pole of the driving transistor T1, and the second pole of the driving transistor T1 is connected to the initialization power supply Vref through the first initializing transistor T4. The data-writing transistor T2 is connected between the data voltage input terminal Vdata and the first pole of the driving transistor T1. The second initializing transistor T5 is connected between the first signal terminal and the first pole of the driving transistor T1. The second pole of the light-emitting element D1 is connected to the second power voltage input terminal Vss.

The pixel circuit further includes the first light-emitting control transistor T6 and a second light-emitting control transistor T7. The first pole of the driving transistor T1 is electrically connected to the first power voltage input terminal Vdd through the first light-emitting control transistor T6, and the second pole of the driving transistor T1 is electrically connected to the first pole of the light-emitting element D1 through the second light-emitting control transistor T7. The second pole of the light-emitting element D1 is electrically connected to the second power voltage input terminal Vss. A first signal terminal is electrically connected to a gate of the second light-emitting control transistor T7.

Referring to FIG. 6, the first signal terminal is electrically connected to the gate of the second light-emitting control transistor T7, that is, a signal input from the first signal terminal serves as a control signal which controls the turn-on or turn-off of the second light-emitting control transistor T7, or the second light-emitting control signal input terminal EM2 which controls the turn-on or turn-off of the second light-emitting control transistor T7 serves as the first signal terminal. In an embodiment, the gate of the compensating transistor T3 is electrically connected to the first scanning signal input terminal Scan1 of the pixel circuit, and the gate of the initializing transistor T4 is electrically connected to the second scanning signal input terminal Scan 2 of the pixel circuit. The gate of the data-writing transistor T2 is electrically connected to a third scanning signal input terminal Scan3, and the gate of the first light-emitting control transistor T6 is electrically connected to the first light-emitting control signal input terminal EM1. The gate of the second light-emitting control transistor T7 is electrically connected to the second light-emitting control signal input terminal EM2. The gate of the second initializing transistor T5 is electrically connected to the second scanning signal input terminal Scan 2.

The driving method for a pixel circuit further includes steps described below.

In the initialization stage, a turn-off control signal is provided for the gate of the second light-emitting control transistor T7. Another mode for implementation of the adequate reset of the driving transistor is provided.

Figure 7:
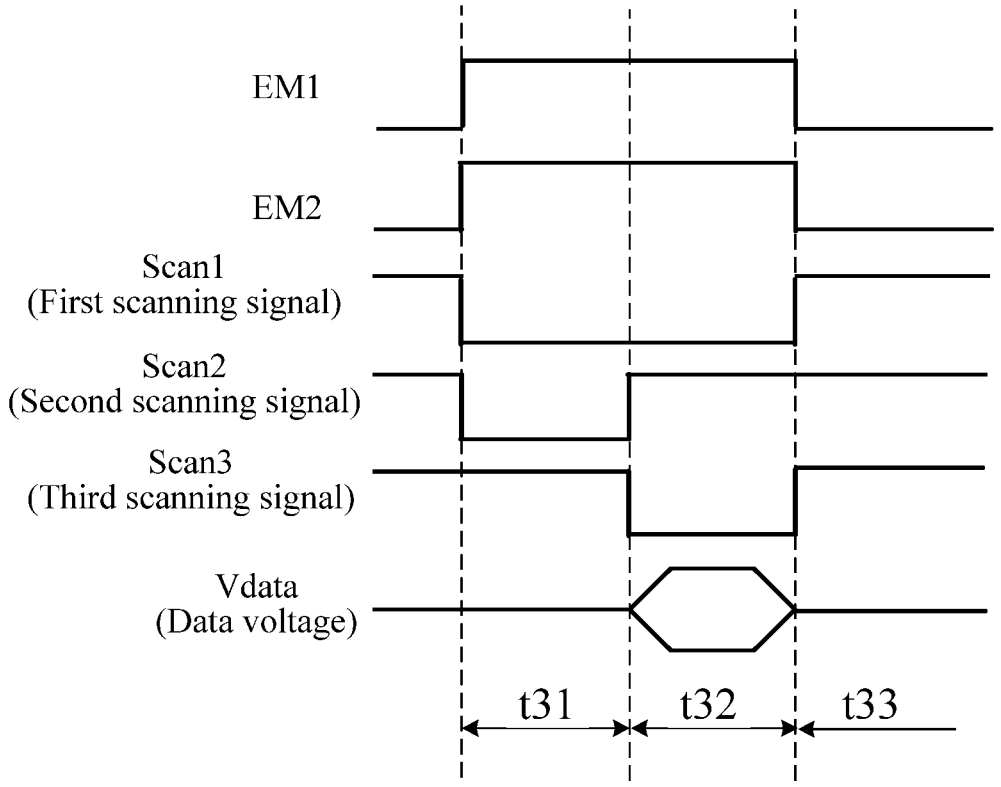
FIG. 7 is a time diagram of the drive of the pixel circuit shown in FIG. 6 according to an embodiment of the present application.

FIG. 7 is a time diagram of the drive of a pixel circuit shown in FIG. 6 according to an embodiment of the present application. Referring to FIGS. 6 to 7, in an initialization stage t31, a low-level signal is provided for the gate of the second initializing transistor T5, that is, a low-level signal is input to the second scanning signal input terminal Scan2, so the second initializing transistor T5 is turned on. A high-level signal provided for the first signal terminal (the second light-emitting control signal input terminal EM2) is transmitted to the first pole of the driving transistor T1 through the second initializing transistor T5 which is turned on, so as to make the first pole of the driving transistor T1 initialized. Meanwhile, the second light-emitting control transistor T7 is turned off according to a high-level signal input from the gate of the second light-emitting control transistor T7. Moreover, in the initialization stage, a low-level signal is provided for the gate of the first initializing transistor T4, that is, a low-level signal is input to the second scanning signal input terminal Scan2, so the first initializing transistor T4 is turned on. A low-level signal is provided for the gate of the compensating transistor T3, that is, a low-level signal is provided for the first scanning signal input terminal Scan1, so the first initializing transistor T4 and the compensating transistor T3 are turned on, which realizes the reset of the gate of the driving transistor T11. In this manner, the driving transistor T1 is completely reset in the initialization stage t31, which is conducive to alleviate the afterimage.

In a data-writing stage t32, a low-level signal is provided for the gate of the data-writing transistor T2, that is, a low-level signal is provided for the third scanning signal input terminal Scan3, so the data-writing transistor T2 is turned on. A low-level signal is provided for the gate of the compensating transistor T3, that is, a low-level signal is provided for the first scanning signal input terminal Scan1, so the compensating transistor T3 is turned on. A data voltage input from the data voltage input terminal Vdata is written into the gate of the driving transistor T1 through the data-writing transistor T2, driving transistor T1 and compensating transistor T3 which are turned on, so as to achieve the write-into of the data voltage and the compensation of the gate voltage of the driving transistor T1.

In a light-emitting stage t33, a low-level signal is provided for the gate of the first light-emitting control transistor T6, that is, a low-level signal is provided for the first light-emitting control signal input terminal EM1, so the first light-emitting control transistor T6 is turned on. A low-level signal is provided for the gate of the second light-emitting control transistor T7, that is, a low-level signal is provided for the second light-emitting control signal input terminal EM2, so the second light-emitting control transistor T7 is turned on, and the driving transistor T1 drives the light-emitting element D1 to emit light.

Referring to FIGS. 6 to 7, in an embodiment, the driving method for a pixel circuit further includes steps below.

In the initialization stage t31, a turn-off control signal is provided for the gate of the first light-emitting control transistor T6.

In an embodiment, in the initialization stage, a turn-off control signal is provided for the gate of the first light-emitting control transistor T6, so that signals provided for the first light-emitting control transistor T6 and the gate of the second light-emitting control transistor T7 in different stages are same, so as to make the gate of the first light-emitting control transistor T6 and the gate of the second light-emitting control transistor T7 connected to the same control signal line of the display panel, which is conducive to reduce the number of wirings in the display panel.

Figure 8:
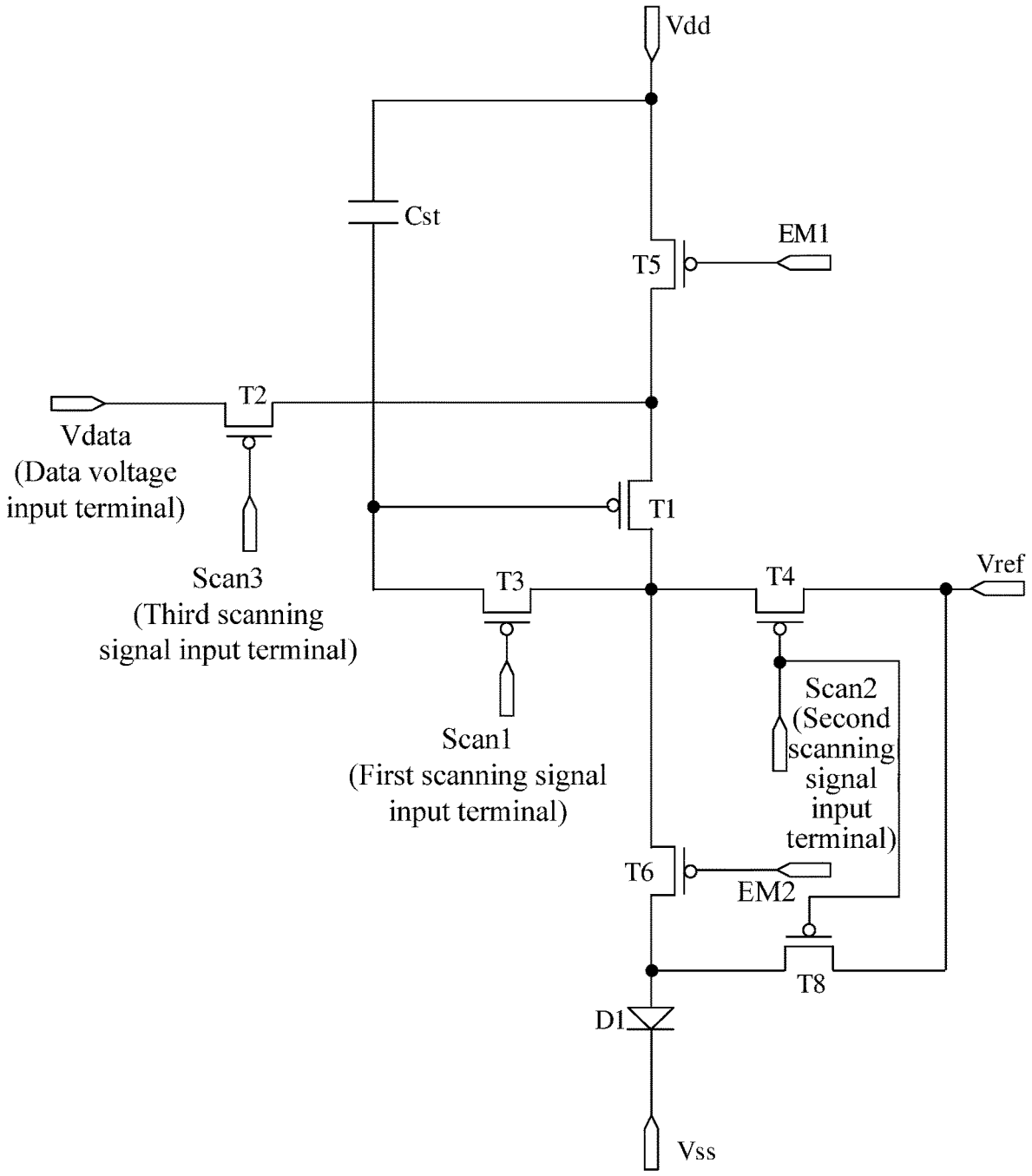
FIG. 8 is a schematic diagram illustrating the structure of another pixel circuit according to an embodiment of the present application.

FIG. 8 is a schematic diagram illustrating the structure of another pixel circuit according to an embodiment of the present application. Referring to FIG. 8, the pixel circuit further includes a third initializing transistor T8 which is connected between the initialization power supply Vref and the first pole of the light-emitting element D1. The driving method further includes steps below.

In the first initialization stage, a turn-on control signal is provided for a gate of the third initializing transistor T8.

Referring to FIG. 8, the gate of the third initializing transistor T8 is electrically connected to the second scanning signal input terminal Scan2. The time sequences of the drive shown in FIGS. 4 to 5 are also applicable to the pixel circuit shown in FIG. 8. In an embodiment, in the initialization stage, a low-level signal is provided for the gate of the third initializing transistor T8, that is, a low-level signal is provided for the second scanning signal input terminal Scan2, so the third initializing transistor T8 is turned on, so as to make the first pole of the light-emitting element D1 initialized, thus preventing the residual charges of the first pole of the light-emitting element D1 from affecting the display effect, thus improving the display effect.

It is noted that the pixel circuit according to any one of the preceding embodiments of the present application further includes a storage capacitor Cst to store a gate potential of the driving transistor, so that the potential of the driving transistor in the light-emitting stage may be well maintained.

Figure 9:
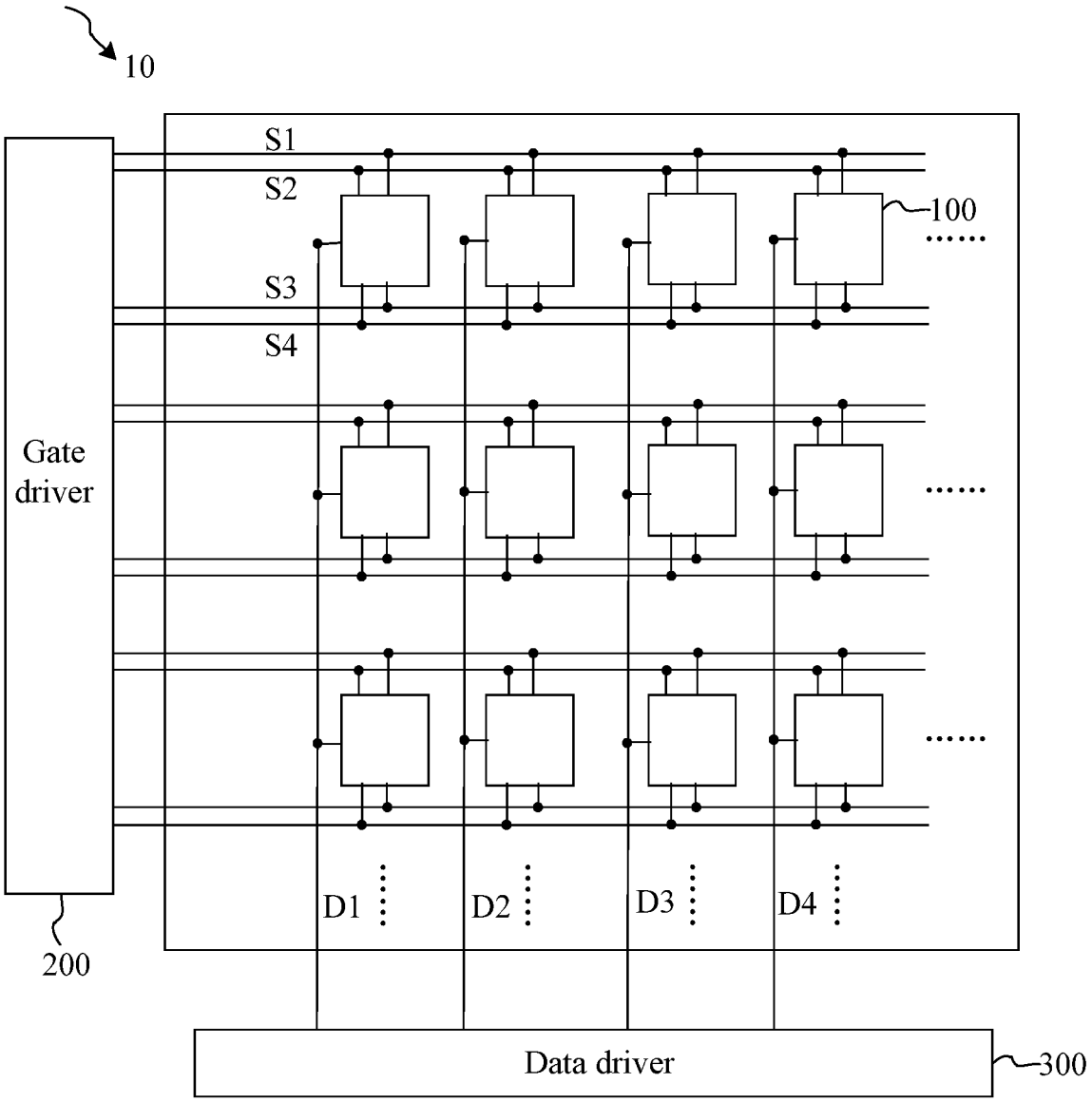
FIG. 9 is a schematic diagram illustrating the structure of a display panel according to an embodiment of the present application.

An embodiment of the present application provides a display panel. FIG. 9 is a schematic diagram illustrating the structure of a display pane according to an embodiment of the present application. Referring to FIG. 9, the display panel 10 includes the pixel circuit 100 according to any one of the embodiments of the present application. The pixel circuit 100 includes a driving transistor, a data-writing transistor, a compensating transistor, a first initializing transistor and a second initializing transistor. The compensating transistor is connected between a gate of the driving transistor and a second pole of the driving transistor, and the second pole of the driving transistor is connected to an initialization power supply through the first initializing transistor. The data-writing transistor is connected between a data voltage input terminal and a first pole of the driving transistor, and the second initializing transistor is connected between a first signal terminal and the first pole of the driving transistor. The pixel circuit 100 further includes a first scanning line S1, a second scanning line S2, a third scanning line S3, a fourth scanning line S4, a data line, a gate driver 200 and a data driver 300.

The first scanning line S1 is electrically connected to a gate of the first initializing transistor of the pixel circuit. The second scanning line S2 is electrically connected to a gate of the compensating transistor. The third scanning line S3 is electrically connected to a gate of the second initializing transistor. The fourth scanning line S4 is electrically connected to a gate of the data-writing transistor. The data lines (D1, D2, D3, D4, . . . ) are electrically connected to the data voltage input terminal.

The first scanning line S1, the second scanning line S2, the third scanning line S3 and the fourth scanning line S4 are electrically connected to output terminals of the gate driver 200 in a one to one correspondence. The data lines are electrically connected to output terminals of the data driver 300.

The gate driver 200 is configured to provide first pulse signals for the first scanning line S1, the second scanning line S2 and the third scanning line S3 in the initialization stage, and the gate driver 200 is configured to provide a first pulse signal for the fourth scanning line S4 in the data-writing stage.

The data driver 300 is configured to provide a data voltage for the data line in the data-writing stage.

A first pulse signal may be a control signal which enables a transistor corresponding to the first pulse signal in the pixel circuit to be turned on. For example, in a case that the transistor corresponding to the first pulse signal in the pixel circuit is a P-type transistor, the first pulse signal is a low-level pulse signal.

In an embodiment, the gate driver 200 may include a scanning driver outputting a scanning pulse signal and a light-emitting control pulse driver outputting a light-emitting control pulse signal. In an embodiment, the display panel further includes the pixel circuit shown in FIG. 2 and FIG. 8. The third scanning line S3 connected to the gate of the second initializing transistor may be electrically connected to the light-emitting control pulse driver.

It is noted that, as for the pixel circuit shown in FIG. 6, since the second initializing transistor and the first initializing transistor are electrically connected to the second scanning signal input terminal, the display panel includes the pixel circuit shown in FIG. 6, in the display panel, the first scanning line and the third scanning line may be scanning lines providing the same scanning pulse signal, or the first scanning line and the third scanning line are combined as one scanning line to reduce the number of wirings.

In the driving method for a pixel circuit according to this embodiment of the present application, first pulse signals are provided for the first scanning line, the second scanning line and the third scanning line through the gate driver in the initialization stage, and a first pulse signal is provided for the fourth scanning line in the data-writing stage. A data voltage is provided for the data line through the data driver in the data-writing stage to realize the adequate reset of the driving transistor. When grayscales are switched in different frames, no matter whether the display grayscale in the preceding frame is the same to the display grayscale in this frame, in the initialization stage of this frame, the driving transistors are returned to the same initialization state, so that during a grayscale switching process, the degrees of capture and release of carriers in an active layer, a gate insulating layer and an interface between the active layer and the gate insulating layer which are inside of the driving transistor tend to be consistent, and when different grayscales are switched to the same grayscale, the driving transistors may generate the same driving current, and the brightness of the light-emitting elements are almost the same, thus alleviating the afterimage.

Figure 10:
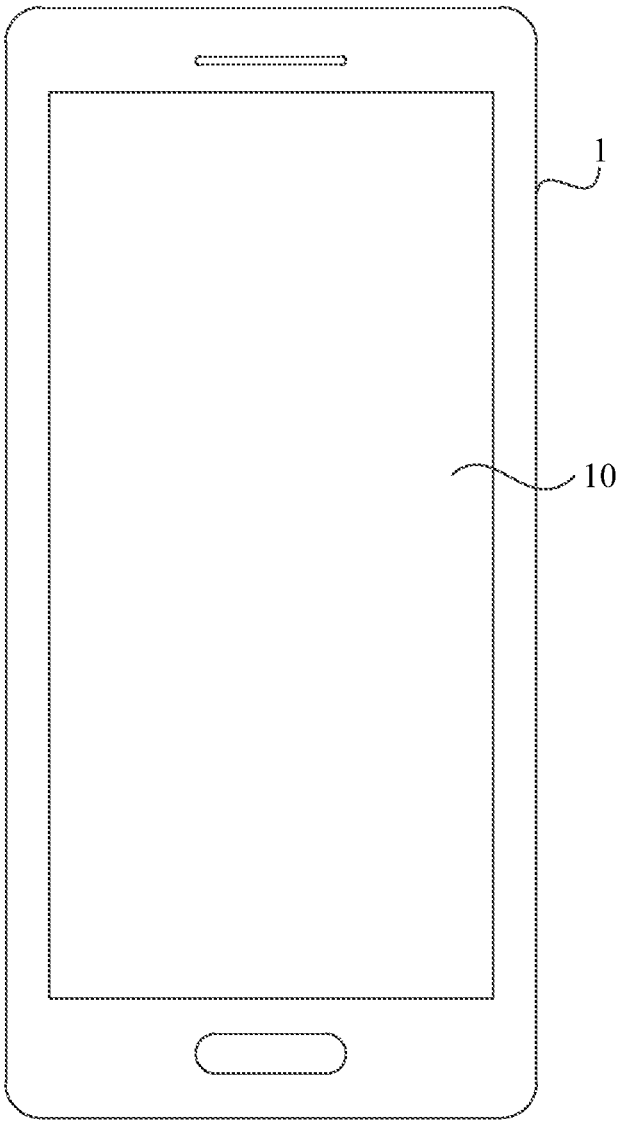
FIG. 10 is a schematic diagram illustrating the structure of a display device according to an embodiment of the present application.

An embodiment of the present application provides a display device. FIG. 10 is a schematic diagram illustrating the structure of a display device according to an embodiment of the present application. Referring to FIG. 10, the display device 1 according to this embodiment of the present application includes the display panel 10 according to any one of the preceding embodiments of the present application. The display device may be a mobile phone shown in FIG. 10 or may be, for example, a computer, a television or an intelligent wearable display device. This is not limited in this embodiment of the present application.

What is claimed is:

1. A driving method for a pixel circuit, the pixel circuit comprising at least one driving transistor, at least one data-writing transistor, at least one compensating transistor, at least one first initializing transistor, at least one second initializing transistor, at least one light-emitting element, a first light-emitting control transistor, and a second light-emitting control transistor, wherein:

the compensating transistor is connected between a gate of the driving transistor and a second pole of the driving transistor, the second pole of the driving transistor is connected to an initialization power supply through the first initializing transistor, the data-writing transistor is connected between a data voltage input terminal and a first pole of the driving transistor, the second initializing transistor is connected between the first pole of the driving transistor and a gate of the second light-emitting control transistor, the second pole of the driving transistor is connected to a first pole of the light-emitting element through the second light-emitting control transistor, a second pole of the light-emitting element is connected to a second power voltage input terminal such that the second pole of the driving transistor is connectable to the second power voltage input terminal through the light-emitting element and the second light-emitting control transistor, and the first pole of the driving transistor is connected to a first power voltage input terminal through the first light-emitting control transistor;

the driving method comprises:

in an initialization stage:

providing turn-on control signals for a gate of the first initializing transistor, a gate of the second initializing transistor, and a gate of the compensating transistor, providing a turn-off control signal for the gate of the second light-emitting control transistor, and providing a fixed voltage for the first power voltage input terminal; and in a data-writing stage, providing a turn-on control signal for a gate of the data-writing transistor.

2. The driving method for a pixel circuit of claim 1, further comprising:

in the initialization stage, providing a turn-off control signal for a gate of the first light-emitting control transistor.

3. The driving method for a pixel circuit of claim 1, wherein within one frame, the initialization stage is performed before the data-writing stage.

4. The driving method for a pixel circuit of claim 1, wherein the first pole of the driving transistor is a source of the driving transistor or a drain of the driving transistor, and the first pole of the driving transistor is the source of the driving transistor in a case that the driving transistor is a P-type transistor; and the first pole of the driving transistor is the drain of the driving transistor in a case that the driving transistor is an N-type transistor.

5. The driving method for a pixel circuit of claim 1, wherein the gate of the compensating transistor is electrically connected to a first scanning signal input terminal of the pixel circuit, the gates of the first and second initializing transistors are electrically connected to a second scanning signal input terminal of the pixel circuit, the gate of the data-writing transistor is electrically connected to a third scanning signal input terminal of the pixel circuit, the gate of the first light-emitting control transistor is electrically connected to a first light-emitting control signal input terminal, and a gate of the second light-emitting control transistor is electrically connected to a second light-emitting control signal input terminal.

6. The driving method for a pixel circuit of claim 1, further comprising:

in a light-emitting stage, providing turn-on control signals for the gates of the first and second light-emitting control transistors.

7. The driving method for a pixel circuit of claim 1, wherein the pixel circuit further comprises a storage capacitor, and the storage capacitor is configured to store a gate potential of the driving transistor so as to maintain the gate potential of the driving transistor in the light-emitting stage.

8. The driving method for a pixel circuit of claim 7, wherein a first pole of the compensation transistor and the gate of the driving transistor are connected to the first power voltage input terminal through the storage capacitor.

9. A driving method for a pixel circuit, the pixel circuit comprising at least one driving transistor, at least one data-writing transistor, at least one compensating transistor, a first initializing transistor, a second initializing transistor, a third initializing transistor, and at least one light-emitting element, wherein:

the compensating transistor is connected between a gate of the driving transistor and a second pole of the driving transistor, the second pole of the driving transistor is connected to an initialization power supply through the first initializing transistor, the data-writing transistor is connected between a data voltage input terminal and a first pole of the driving transistor, the second initializing transistor is connected between a first power voltage input terminal and the first pole of the driving transistor, the lighting element is connected between the second pole of the driving transistor and a second power voltage input terminal, the third initializing transistor is connected between the initialization power supply and a first pole of the light emitting element, and a gate of the first initializing transistor is connected to a gate of the third initializing transistor;

the driving method comprises:

in an initialization stage:

providing turn-on control signals for a gate of the first initializing transistor, the gates of the second and third initializing transistors, and a gate of the compensating transistor, providing a fixed voltage for the first power voltage input terminal; and in a data-writing stage, providing a turn-on control signal for a gate of the data-writing transistor.

10. A display panel comprising a pixel circuit, the pixel circuit comprising:

at least one driving transistor, at least one data-writing transistor, at least one compensating transistor, a first initializing transistor, a second initializing transistor, a first light-emitting control transistor, and a second light-emitting control transistor, wherein:

the compensating transistor is connected between a gate of the driving transistor and a second pole of the driving transistor, the second pole of the driving transistor is connected to an initialization power supply through the first initializing transistor, the data-writing transistor is connected between a data voltage input terminal and a first pole of the driving transistor, the second initializing transistor is connected between the first pole of the driving transistor and a gate of the second light-emitting control transistor, the second pole of the driving transistor is connected to a first pole of a light-emitting element through the second light-emitting control transistor, a second pole of the light-emitting element is connected to a second power voltage input terminal such that the second pole of the driving transistor is connectable to the second power voltage input terminal through the light-emitting element and the second light-emitting control transistor, and the first pole of the driving transistor is connected to a first power voltage input terminal through the first light-emitting control transistor;

wherein the pixel circuit further comprises a first scanning line, a second scanning line, a third scanning line, a fourth scanning line, a data line, a gate driver and a data driver;

wherein the first scanning line is electrically connected to gates of the first and second initializing transistors of the pixel circuit, the second scanning line is electrically connected to a gate of the compensating transistor, the third scanning line is electrically connected to a gate of the first light-emitting control transistor, the fourth scanning line is electrically connected to a gate of the data-writing transistor, and the data line is electrically connected to the data voltage input terminal;

wherein the first scanning line, the second scanning line, the third scanning line and the fourth scanning line are electrically connected to output terminals of the gate driver in a one to one correspondence, and the data line is electrically connected to an output terminal of the data driver;

the gate driver is configured to provide a first pulse signal for the first scanning line, the second scanning line and the third scanning line in an initialization stage, and the gate driver is configured to provide a first pulse signal for the fourth scanning line in a data-writing stage; and the data driver is configured to provide a data voltage for the data line in the data-writing stage.

11. The display panel of claim 10, wherein the first pulse signal is a control signal to turn on a transistor corresponding to the first pulse signal in the pixel circuit, and in a case that the transistor corresponding to the first pulse signal in the pixel circuit is a P-type transistor, the first pulse signal is a low-level pulse signal.

12. The display panel of claim 10, wherein the gate driver comprises a scanning driver for outputting a scanning pulse signal and a light-emitting control pulse driver for outputting a light-emitting control pulse signal.

13. The display panel of claim 12, wherein the third scanning line is electrically connected to the light-emitting control pulse driver.

* * * * *